US005769682A

United States Patent [19]

DiResta et al.

[11] Patent Number: 5,769,682

[45] Date of Patent: *Jun. 23, 1998

[54] SQUEEZABLE PLAYTHING SIMULATING HUMANOID FIGURE

[76] Inventors: Joseph G. DiResta; James DiResta, both of 1078 W. Broadway; Perry Gargano, 92 Horatio St. #4L, all of Woodmere, N.Y. 11598

[ * ] Notice: The term of this patent shall not extend beyond the expiration date of Pat. No. 5,577,723.

[21] Appl. No.: 714,417

[22] Filed: Sep. 16, 1996

Related U.S. Application Data

[63] Continuation-in-part of Ser. No. 543,615, Oct. 16, 1995, Pat. No. 5,577,723.

[51] Int. Cl.[6] ..... A63H 3/28; A63B 41/00

[52] U.S. Cl. ..... 446/184; 446/188; 446/267; 473/571

[58] Field of Search ..... 446/188, 267, 446/180, 183, 184, 295; 473/571, 594, 595, 609, 610

[56] References Cited

U.S. PATENT DOCUMENTS

| | | | |
|---|---|---|---|
| 2,351,762 | 6/1944 | Hoover | 446/269 |
| 2,619,257 | 11/1952 | Posner | 446/183 X |
| 3,822,500 | 7/1974 | Ostrander | 446/183 |
| 3,977,292 | 8/1976 | Faville et al. | 446/184 X |
| 4,040,619 | 8/1977 | Landi | 446/490 X |
| 4,242,830 | 1/1981 | Hauser | 446/267 X |
| 5,006,375 | 4/1991 | Mangan | 446/267 X |
| 5,462,273 | 10/1995 | Spector | 473/594 |
| 5,577,723 | 11/1996 | DiResta et al. | 446/267 X |

*Primary Examiner*—Mickey Yu
*Attorney, Agent, or Firm*—Michael Ebert

[57] ABSTRACT

A squeezable toy plaything which simulates an organic object, such as a human organ, a body part, or a humanoid figure, which plaything when squeezed and released then generates a gurgling sound. The plaything includes a generally spherical outer shell formed of flexible transparent plastic film encasing a hollow inner core. The core is molded of resilient plastic material whose outer surface is contoured to simulate the appearance of the object, the core being provided with an orifice which renders the hollow core collapsible. Injected into the core through the orifice is a charge of oil or other viscous liquid. When the ball is squeezed and deformed, oil and air are discharged from the orifice into the confined spaces between the core and shell, and when the ball is then released to recover its normal shape, oil and air are then sucked back into the shell, these actions producing a gurgling sound.

5 Claims, 2 Drawing Sheets

SQUEEZABLE PLAYTHING SIMULATING HUMANOID FIGURE

RELATED APPLICATION

This application is a continuation-in-part of the DiResta et al. application Ser. No. 08/543,615, filed Oct. 16, 1995 entitled "Squeezable Toy Ball now U.S. Pat. No. 5,577,723."

BACKGROUND OF INVENTION

1. Field of Invention

This invention relates generally to squeezable toy playthings, and more particularly to a plaything of this type which simulates the appearance of an organic object, which plaything, when squeezed, generating a gurgling sound.

2. Status of Prior Art

The patents to Osher et al. U.S. Pat. Nos. 5,026,054 and 4,9444,363 disclose squeezable toy balls having a flexible polymer shell encasing a resiliently deformable inner core of highly plasticized material. Because of the highly plasticized nature of the polymeric core, the toy ball has a soft and supple resilient feeling to one who holds and squeezes it. According to these patents, the feel of the ball is both intriguing and relaxing.

It is also known to provide toy balls having a humanoid form. Thus the Tarnoff U.S. Pat. No. 4,952,190 shows a toy formed from a molded flexible bladder having a humanoid shape, the bladder being filled with a mixture of plastic microspheres and water so that the toy can be thrown or hit, yet can be caught with the bare hand. The rubber ball disclosed in the Johns U.S. Pat. No. 2,960,794 is molded to include pop out parts which when the ball is squeezed, pop out to create facial features, such as a nose and ears.

The patent to Hoover U.S. Pat. No. 2,351,762 discloses a toy having a transparent outer plastic shell enclosing an inner hollow core formed as a plurality of body parts. The British patent 743,653 to Dash shows a hollow toy figure having an orifice which creates a sound when the figure is squeezed.

The concern of the present invention is with a squeezable ball which qualifies as a "gross" toy; that is a toy that is disgusting. However, the fact that the toy may offend the taste of most adults does not detract from its appeal top children, for children are attracted to gross toys as they are to horror movies repugnant to many adults.

The psychological justification for a gross toy is the same as for many classic fairy tales, such as Little Red Riding Hood whose grandmother is devoured by a wolf. Horror movies and fairy tales make it possible for a child to vicariously experience the horrors of the real world and to prepare to cope with these horrors. And while the internal organs of a human body, such as the intestine and the brain, are not playthings in the usual sense and are not visually appealing, they hold a fascination for children.

The above-identified DiResta et al. co-pending application discloses a "gross" toy in the form of a squeezable playball in which a collapsible hollow core is encased within a shell molded of resilient plastic film shaped to simulate a human organ or body part.

This hollow core is provided with an orifice to render it collapsible, for when the core is squeezed, the air within the core is expelled through the orifice. A charge of viscous fluid is injected into the core through the orifice whereby when the ball is squeezed to deform it and is then released so that the core resumes its normal shape, air and liquid are then discharged through the orifice into the confined spaces between the core and the shell to produce gurgling sounds.

SUMMARY OF INVENTION

In view of the foregoing, the main object of this invention is to provide a "gross" toy in the form of a squeezable plaything whose appearance simulates that of an organic object, such as a human organ, a body part or the entire body of a humanoid figure.

More particularly, an object of the invention is to provide a squeezable plaything of the above type which can be hit or thrown like an ordinary ball or be used as a finger exercise, yet when squeezed generates gurgling sounds emulating those made by a functioning organic object.

A significant feature of a "gross" toy, in accordance with the invention is that it is a realistic replica of a human organ or other organic object which a child is able to view and manipulate and thereby gain an understanding of its purpose and function.

Also an object of this invention is to provide a squeezable toy plaything which may be mass produced at low cost, the plaything being sturdy and capable of withstanding rough handling.

Briefly stated, these objects are attained by a squeezable toy plaything which simulates an organic object such as a human organ, which plaything when squeezed and released then generates a gurgling sound similar to that produced by a functioning organ. The plaything is formed from a liquid-impermeable outer shell of flexible plastic film material encasing a hollow inner core of resilient plastic material molded to simulate the appearance of the organic object, so that one is able to see and play with this object.

The hollow core is provided with an orifice to render it collapsible. Injected into the core through the orifice is a charge of oil or other viscous liquid. When the ball is squeezed ad deformed, oil and air are discharged from the orifice into the confined spaces between the core and casing, and when the ball is then released to recover its normal shape, oil and air are then sucked back into the casing, these actions produce a gurgling sound.

BRIEF DESCRIPTION OF DRAWING

For a better understanding of the invention reference is made to the detailed description to follow which is to be read in conjunction with the accompanying drawings of which.

DESCRIPTION OF INVENTION

Figure 1:
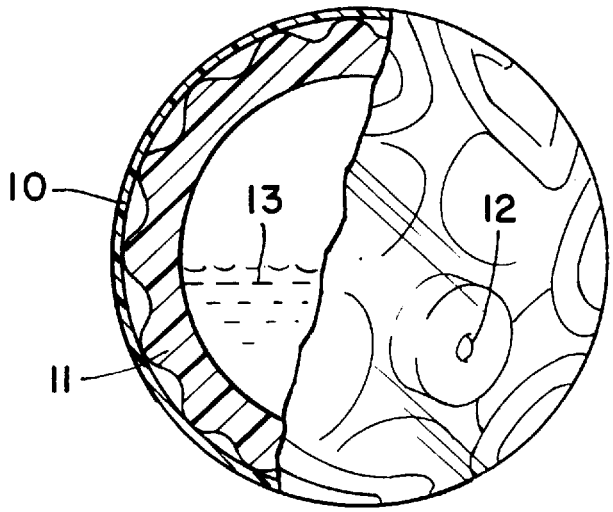
FIG. 1 shows first embodiment of a squeezable toy ball in accordance with the invention whose outer shell is cut away to expose the hollow inner core encased therein.

First Embodiment:

Referring now to FIG. 1, there is shown a "gross" toy in the form of a squeezable ball in accordance with the invention, the ball being formed by an outer shell 10 encasing a hollow collapsible inner core 11.

Outer shell 10 which is generally spherical, is formed by a transparent flexible film of synthetic plastic material of high strength and good clarity, such as silicone plastic, polypropylene or polyethylene, the shell being impermeable to liquids. Hollow inner core 11 is molded of resilient synthetic plastic material such as PVC or polyurethane. Core 11 is molded to simulate the appearance of a human intestine to provide a realistic replica thereof which is viewable through transparent shell 10. The core material is dyed or pigmented to impart a blood-like, venous color thereto.

A human intestine is the mid and hind portion of the alimentary canal formed by a long, more or less convoluted tube that is bunched. The intestine transports food material and digestive residues by means of muscular contractions, and it acts as a site for the digestive process which involves enzymes secreted by the mucous membrane which lines the walls of the intestinal tube. The digestive process which involves intestinal fluids produces gurgling sounds.

Figure 2:
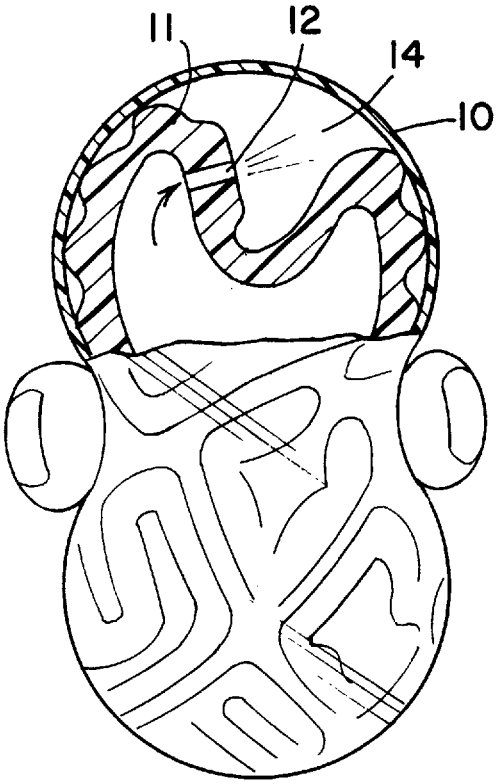
FIG. 2 shows the form of the ball when it is squeezed.

The distal opening of the alimentary canal is the anus, and as shown in FIGS. 1 and 2, the bunched alimentary canal which forms the intestine includes an anus opening 12 in a recessed portion of the hollow plastic core 11. Because of this opening, the hollow core 11 is collapsible, for when it is squeezed, the air confined within the core is ejected therefrom.

While the molded plastic mass which forms the replica of an intestine has recessed surfaces which define the convoluted tube of the intestine, the bunched mass is somewhat spherical and occupies the interior of the spherical outer shell or casing 10. There are, however, free spaces between the outer casing and the inner core where the core is indented or recessed.

Injected into hollow core 11 through orifice 12 is a charge 13 of an inert viscous fluid, such as silicone or mineral oil. When, therefore, the ball is squeezed by a player and deformed, as shown in FIG. 2 the resultant internal pressure causes air and oil to be discharged as a spray 14 from orifice 12 into the confined spaces between the outer surface of the core and the inner surface of the casing. When the ball is released to recover its normal form, air and oil are then sucked back through the orifice into the hollow of the casing.

The discharge of air and oil from orifice 12 produces gurgling sounds, these sounds also being produced when air and oil are sucked back into the hollow of the core. These sounds are similar to these produced by a functioning natural intestine.

One who plays with this squeezable ball by throwing it and catching it, in effect is using a human organ as a ball. There is some historic precedent for this play activity, for the Aztec Indians were known to use human skulls as playbills presumably the skulls of their enemies.

Hence the ball qualifies as a "gross" or horror toy. But it is more than just that, for the replica of the intestine is realistic and gives the child playing with it an appreciation of the structure and function of this extraordinary human organ.

The cerebral cortex of the brain formed of gray matter in the cerebral hemisphere has a convoluted form somewhat similar in appearance to an intestine. Core 11 may therefore be molded and colored to simulate the cerebral cortex. Or the core may be molded to provide a hollow resilient plastic replica of the pancreas or other organs or parts of the human body.

The squeezable ball shown in FIGS. 1 and 2 can be used as a finger exerciser rather than as a play ball. The user, by grasping the ball in one hand, can repeatedly squeeze the ball with his fingers and thereby beneficially exercise the finger muscles. In this exercise mode, the gurgling sounds produced each time the ball is squeezed and then release are indicative of this action, for the harder the user squeezes, the louder are the gurgling sounds. In practice, a user may grasp a ball in each hand and simultaneously squeeze both balls.

Figure 5:
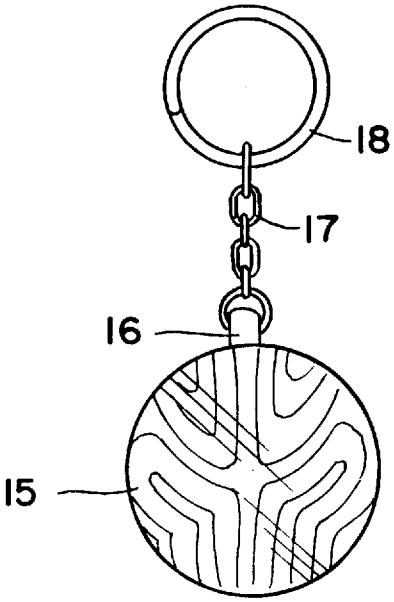
FIG. 5 shows a small scale ball in accordance with the invention wearable as a pendent.

A ball of the type shown in FIG. 2 may be produced in a much smaller scale, such as the suqeezable ball 15 shown in FIG. 5 which has a diameter of about 1.5 inches rather than a playball diameter of about 3 inches. This miniature ball in which is encased a squeezable replica of a human intestine, can serve as a pendant or charm. For this purpose anchored at the upper pole of ball 15 is a post 16 which is coupled by a chain 17 to key ring 18.

And the play ball may be produced in a much larger version, say a ball having a six or eight inch diameter and encasing a replica of a human skull formed of resilient plastic material, so that a player can kick this skull.

Figure 3:
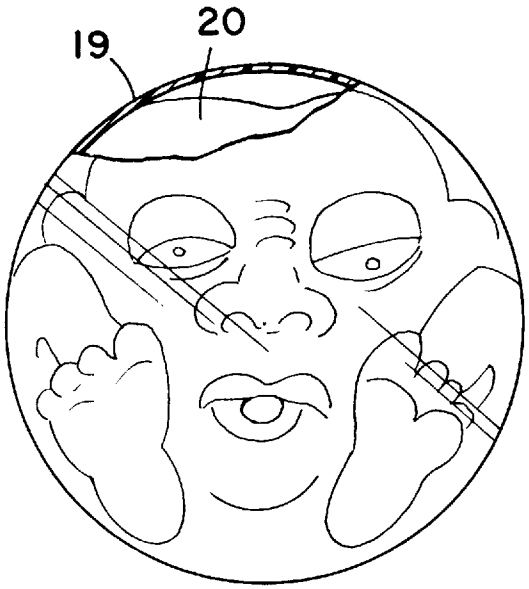
FIG. 3 illustrates a second embodiment of a squeezable toy ball.

Second Embodiment:

The "gross" toy playball shown in FIG. 3 is generally the same as that shown in FIG. 1 and is provided with an outer film plastic shell 19 encasing a hollow collapsible inner core 20 molded of resilient plastic material having an orifice therein in which a fluid is ejected to produce a gurgling sound when the ball is squeezed and then released.

However, in this second embodiment the molded inner core 20 is not a replica of a human organ, but that of a humanoid figure whose arms, legs and feet are huddled about round torso so that the figure appears to be tightly compressed within outer shell 19.

When the ball is squeezed, air and fluid are ejected from the orifice in the core into the irregular spaces between the core whose surface is contoured to define the figure and the transparent plastic film casing enclosing the figure. And when the ball is released to cause the figure to resume its normal "gross" appearance, the air and fluid are sucked back into the hollow core to produce gurgling sounds.

Figure 4:
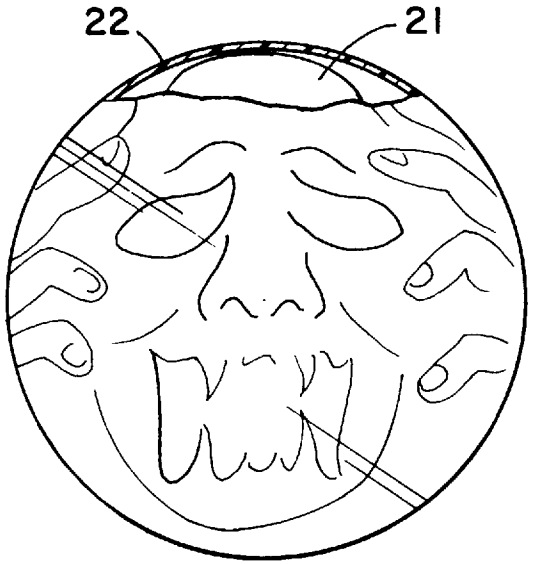
FIG. 4 illustrates a third embodiment of a squeezable toy ball.

Third Embodiment:

In the third embodiment of the squeezable ball, as shown in FIG. 4, the ball is formed of a molded hollow core 21 which takes the form of a monster figure having jagged lips, the monster holding his head in his hands. Core 21 is enclosed in an outer shell 22 as in FIG. 1.

Thus while the hollow core may take a humanoid form rather than be a replica of a human organ, the nature of the core should be somewhat disgusting, at least to adults, and therefore creates a gross toy.

While there has been shown preferred embodiments of squeezable toy playthings in accordance with the invention, it will be appreciated that many changes may be made therein without departing from the spirit of the invention. Thus instead of a ball having a hollow core provided with an orifice therein to render it squeezable, the squeezable core may be molded of a solid body of open-cell resilient foam plastic material, such as medium-density polyurethane, the body being impregnated with a viscous fluid which is extruded from the body when it is squeezed to produce gurgling sounds, the fluid being sucked back into the cells of the body when the ball is released to produce gurgling sounds.

While there has been shown and disclosed preferred embodiments of the invention, it will be appreciated that many changes may be made therein without departing from the spirit of the invention.

We claim:

1. A squeezable toy plaything comprising:

A. a globular outer shell formed of flexible transparent plastic film;

B. a hollow core encased in the shell having an orifice therein to render the core collapsible, said core being molded of resilient plastic material whose outer surface is contoured to define a humanoid figure which is entrapped within the shell; and C. a charge of viscous liquid injected into said core through the orifice whereby when the plaything is squeezed to deform the figure, air and said liquid is discharged through said orifice into a confined space between said core and said shell, and when the plaything is then released to cause the figure to resume its normal form, the air and said liquid are then sucked back into the core, these actions generating gurgling sounds.

2. A plaything as set forth in claim 1, in which the plaything has the dimensions of a playball which can be thrown and caught.

3. A plaything as set forth in claim 1, in which the plaything has a diameter of about 1.5 inches and has a post anchored therein to which a chain is attached to provide a pendant.

4. A plaything as set forth in claim 1, in which the humanoid figure is that of a monster.

5. A plaything as set forth in claim 1, in which the viscous fluid is silicone oil.

* * * * *